US009777444B1

(12) United States Patent
Dellario

(10) Patent No.: US 9,777,444 B1
(45) Date of Patent: Oct. 3, 2017

(54) SELF-LUBRICATING ASPHALT RAKE

(71) Applicant: Michael S. Dellario, Middleport, NY (US)

(72) Inventor: Michael S. Dellario, Middleport, NY (US)

( * ) Notice: Subject to any disclaimer, the term of this patent is extended or adjusted under 35 U.S.C. 154(b) by 0 days.

(21) Appl. No.: 15/490,106

(22) Filed: Apr. 18, 2017

Related U.S. Application Data

(60) Provisional application No. 62/355,452, filed on Jun. 28, 2016.

(51) Int. Cl.
*E01C 19/44* (2006.01)
*A01D 7/00* (2006.01)

(52) U.S. Cl.
CPC ..... *E01C 19/44* (2013.01)

(58) Field of Classification Search
CPC ..... A01D 7/00; E01C 19/44
USPC ..... 56/400.04, 400.08, 400.16; 404/93, 111, 404/97, 118
See application file for complete search history.

(56) References Cited

U.S. PATENT DOCUMENTS 1,629,389 A 5/1927 Johnson
2,638,730 A * 5/1953 Davidson ..... A01G 25/00 111/7.1
2,897,826 A 8/1959 Di Vito
3,753,408 A * 8/1973 Zimmerman ..... A01C 23/02 111/7.1
4,022,382 A * 5/1977 Engdahl, Jr. ..... B05B 1/202 134/172
4,055,195 A 10/1977 Moses
4,057,901 A 11/1977 Bloem
4,095,746 A * 6/1978 Anderberg ..... B05B 1/202 239/754
4,165,192 A * 8/1979 Mellen ..... E01C 19/16 401/137
4,913,172 A 4/1990 Chou
5,365,880 A 11/1994 South
5,822,968 A * 10/1998 Savala ..... A01D 7/00 239/289
6,024,052 A 2/2000 Efaw
6,035,806 A 3/2000 Lorenzo
6,413,002 B1 * 7/2002 Delaine, Jr. ..... A46B 11/063 401/268
6,474,896 B1 * 11/2002 DeLaine, Jr. ..... A46B 11/063 401/137
6,935,579 B1 * 8/2005 Lindsey ..... A47L 13/23 119/604
7,063,281 B2 * 6/2006 Schommer ..... B05B 7/0884 239/428.5
7,217,053 B2 * 5/2007 Alexander ..... A47L 13/11 15/321

(Continued)

*Primary Examiner* — Gary Hartmann
(74) *Attorney, Agent, or Firm* — Hodgson Russ LLP

(57) ABSTRACT

An asphalt rake includes a handle, a rake head, and a valve. The handle includes a cavity to hold a fluid, such as a release agent. The rake head has a passage in fluid communication with the outlet of the handle. The passage is in fluid connection with a support member outlet that is configured to be positioned apart from the crossbar by a gap. The valve controls fluid flowing from the cavity in the handle to the rake head. Fluid applied to tines of the rake head can prevent asphalt buildup on the rake head when smoothing or otherwise working with asphalt.

17 Claims, 8 Drawing Sheets

(56) References Cited

U.S. PATENT DOCUMENTS

| | | | | |
|---|---|---|---|---|
| 7,234,419 | B2 | 6/2007 | Hutchinson et al. | |
| 9,295,193 | B2 * | 3/2016 | Mayer | A01D 44/00 |

* cited by examiner

SELF-LUBRICATING ASPHALT RAKE

CROSS-REFERENCE TO RELATED APPLICATIONS

This application claims priority to the provisional patent application filed Jun. 28, 2016 and assigned U.S. App. No. 62/355,452, the disclosure of which is hereby incorporated by reference.

FIELD OF THE DISCLOSURE

This disclosure relates to hand tools and, more particularly, to asphalt rakes.

BACKGROUND OF THE DISCLOSURE

When working with asphalt, workers typically smooth out the material with an asphalt rake. Different applications can require various asphalt rake heads, such as for raking the top course, binder course, and base course. However, when raking the asphalt, fresh asphalt will stick to the rake head, requiring workers to constantly clean off the rake head. Workers may try to prevent asphalt from sticking to a rake head by applying a release agent to the rake. However, applying the release agent to the rake head can be time consuming and carrying a separate container for the release agent can be cumbersome. Furthermore, the release agent may be located a distance from the worker, which requires that the worker stop working and navigate to the release agent without stepping on the fresh asphalt.

Therefore, an asphalt rake having an integral method of storing and applying a release agent is needed.

BRIEF SUMMARY OF THE DISCLOSURE

An asphalt rake is provided. The asphalt rake includes a handle and a rake head. The handle defines a cavity, an inlet in fluid communication with the cavity, and an outlet in fluid communication with the cavity. The inlet and the outlet are disposed on opposite ends of the handle. The rake head includes a crossbar, a plurality of tines projecting from the crossbar, and a support member configured to hold the handle. The crossbar defines a plurality of holes between a first side and a second side. The support member has a passage in fluid communication with the outlet of the handle. The passage is in fluid connection with a support member outlet that is configured to be positioned apart from the crossbar by a gap. A valve is disposed in the handle. The valve is configured to control fluid flowing from the cavity in the handle to the rake head.

The inlet may be disposed on a proximal end of the handle and the outlet may be disposed on a distal end of the handle. The cavity can be disposed between the inlet and the outlet.

The cavity can be configured to hold at least a quart of fluid.

The asphalt rake may further include a bubble level disposed on the support member.

The asphalt rake may further include a pair of support arms and a collar. The collar can be disposed around the handle and the support arms can connect the collar to the rake head.

The rake head may be fabricated entirely of aluminum or an aluminum alloy.

The asphalt rake may further include an activator connected to the valve.

The rake head may be configured to connect with the handle using a screw connection. The handle can be configured to be disconnected from the rake head.

The asphalt rake may further include a second rake head. The second rake head can be different from the rake head. The second rake head can include a second support member configured to hold the handle. The second rake head can be configured to be connected with the handle.

The passage of the support member can be configured to enable fluid flow to the crossbar. The passage may have a straight bore.

The valve may be disposed more proximate to the outlet of the handle than the inlet of the handle.

A seal can be formed between the handle and the support member.

The holes in the crossbar can be configured to enable fluid flow between the first side and the second side of the rake head.

The holes in the crossbar may project approximately parallel to the fluid flow in the rake head or approximately parallel to the direction that the handle extends.

At least part of an exterior surface of the rake head may include a non-stick coating.

DESCRIPTION OF THE DRAWINGS

For a fuller understanding of the nature and objects of the disclosure, reference should be made to the following detailed description taken in conjunction with the accompanying drawings, in which.

DETAILED DESCRIPTION OF THE DISCLOSURE

Although claimed subject matter will be described in terms of certain embodiments, other embodiments, including embodiments that do not provide all of the benefits and features set forth herein, are also within the scope of this disclosure. Various structural and process step changes may be made without departing from the scope of the disclosure. Accordingly, the scope of the disclosure is defined only by reference to the appended claims.

Embodiments of the rake disclosed herein include a reservoir disposed in the handle. The reservoir can dispense a fluid, such as a release agent, onto the rake head. This can prevent asphalt buildup on the rake head, which provides convenience and improves efficiency when smoothing or otherwise working with asphalt.

Figure 1:
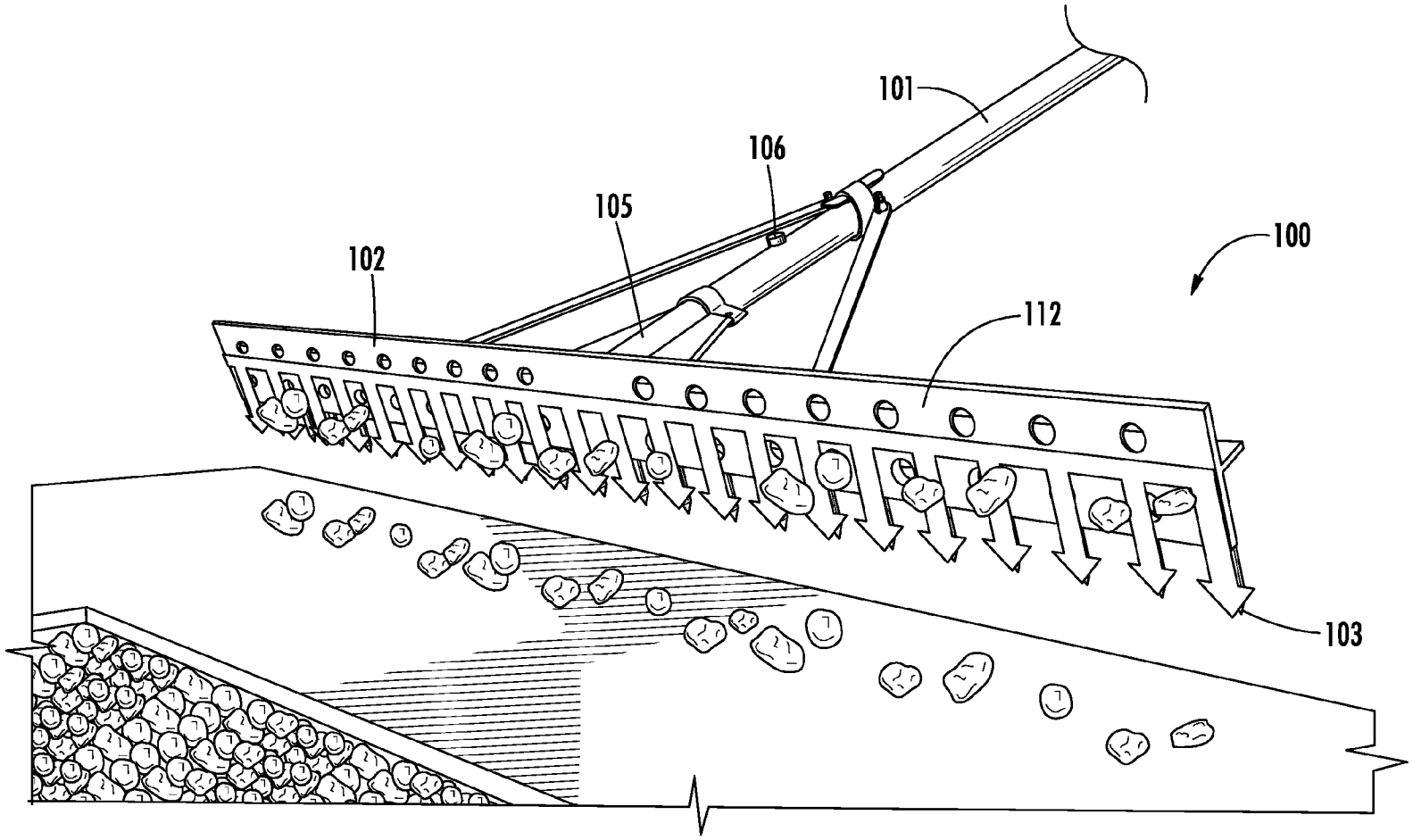
FIG. 1 shows a perspective view of the front side of the distal end of the self-lubricating asphalt rake.

FIG. 1 shows a perspective view of the front side of the distal end of the self-lubricating asphalt rake. A self-lubricating asphalt rake 100 lubricates the tines 103 of the asphalt rake 100. The asphalt rake includes a handle 101 with a distal end 105 and a proximal end 104. The handle 101 also includes a reservoir. The reservoir of the handle 101 is configured to contain a fluid, such as a release agent. A rake head 102 with a plurality of tines 103 is mounted onto the distal end 105 of the handle 101. An activator 106 is disposed on the rake head 102 or on the handle 101 toward the distal end 105 of the rake head 102. The activator 106 is configured to control the flow of fluid from the handle 101 to the tines 103. The arrows on the tines 103 represent flow of the fluid down the tines 103. The activator 106 can be positioned elsewhere on the handle 101 or rake head 102 than as illustrated in FIG. 1.

Figure 2:
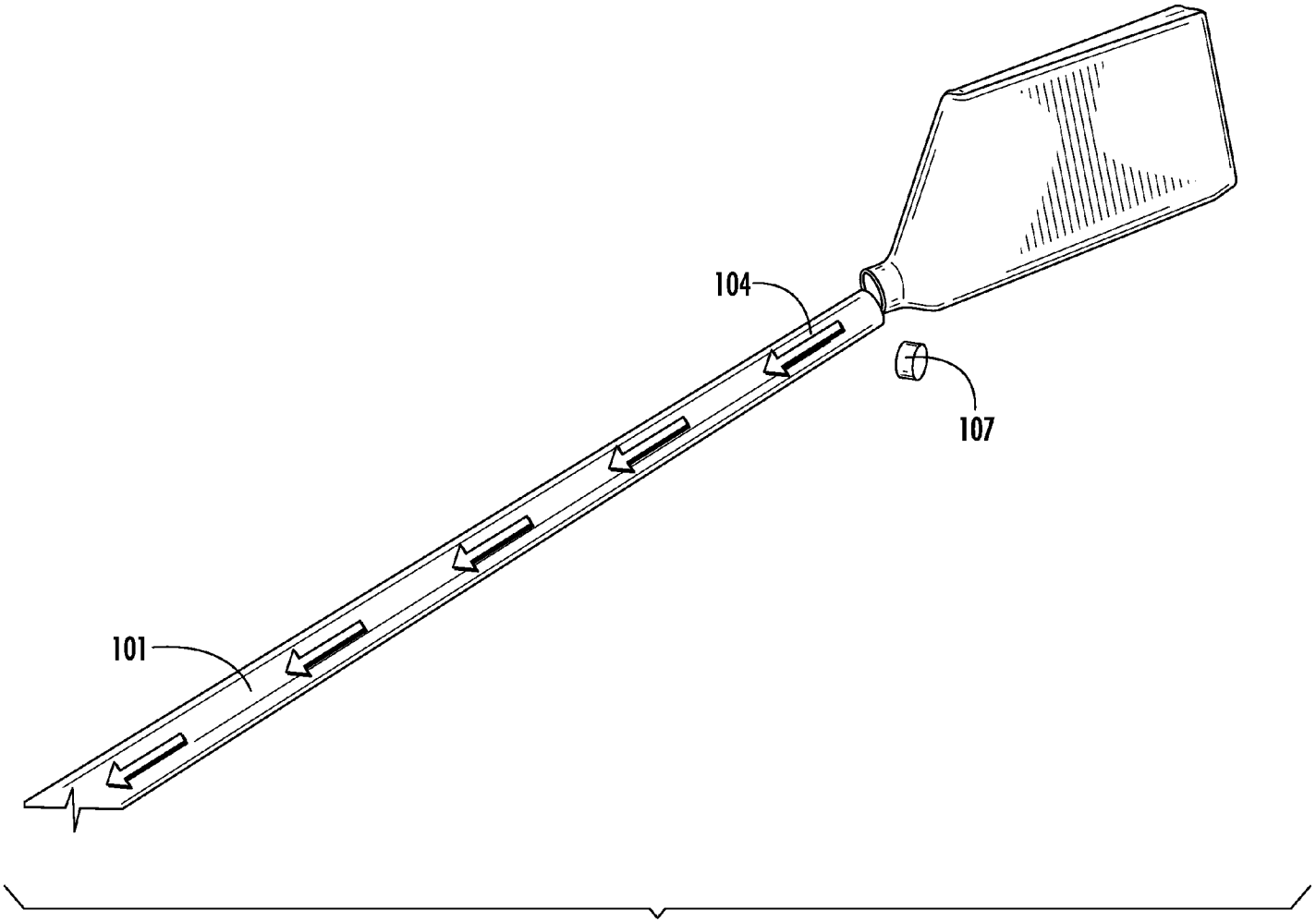
FIG. 2 shows a perspective view of the proximal end of a handle of the self-lubricating asphalt rake with release agent being poured therein.

FIG. 2 shows a perspective view of the proximal end 104 of the handle 101. As seen in FIG. 2, a fluid, such as release agent, can be poured into the proximal end 104 of the handle 101. A cap 107, which may be configured to be screwed into the handle 101, may be used to seal the end of the handle 101 and prevent the fluid from leaking out during use of the asphalt rake. A press fit, latch, or another sealing mechanism can be used to seal the end of the handle 101 with the cap 107 and prevent the fluid from leaking out during use of the handle 101. Gaskets, o-rings, or other mechanisms can be used to improve the seal.

The inlet for the fluid in the proximal end 104 of the handle 101 may be a straight bore. The inlet in the proximal end 104 of the handle 101 also may be shaped to improve pouring or reduce spillage, such as by including a funnel.

Figure 3:
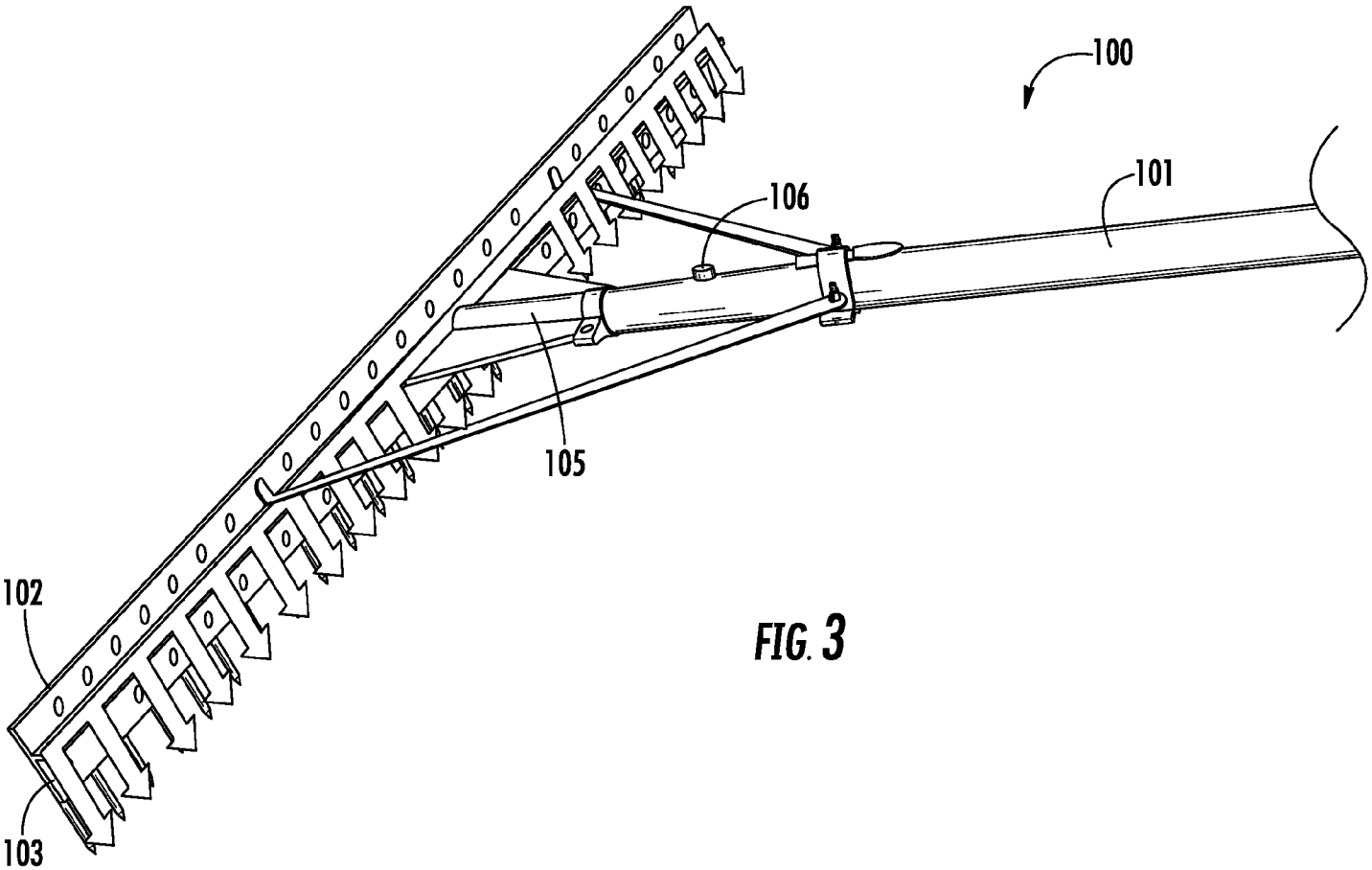
FIG. 3 shows a perspective view of the back side of the distal end of the self-lubricating asphalt rake.
Figure 4:
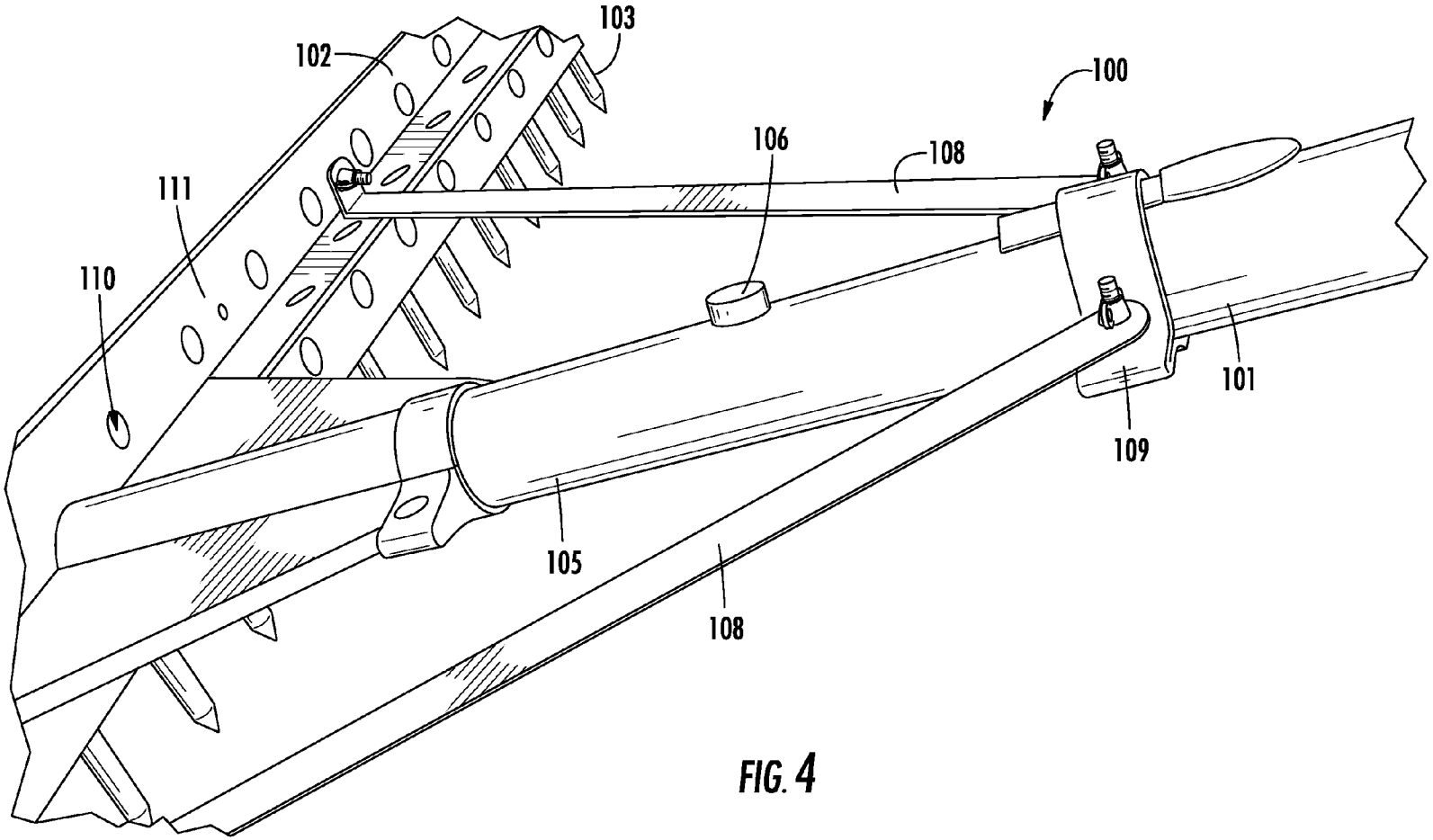
FIG. 4 shows a perspective view of the distal end of the handle of the self-lubricating asphalt rake.

FIG. 3 shows a perspective view of the back side of the distal end 105 of the asphalt rake 101. FIG. 4 shows a perspective view of the distal end 105 of the handle 101 of the asphalt rake 100. The arrows on the tines 103 in FIG. 3 represent flow of the fluid down the tines 103. As seen in FIG. 4, arms 108 and a guide member 109 can be included, which can support the handle 101. The rake head 102 can define one or more holes 110 between the first side 111 and the opposing second side 112 (seen in FIG. 1). Thus, the tines 103 can be more easily wetted on all sides. The holes 110 may be in the crossbar of the rake head 102, such as the crossbar 203 seen in FIG. 6. The holes 110 in the crossbar are configured to enable fluid flow between the first side 111 and the second side 112 of the rake head 102. The second side 112 may be considered the front side and the first side 111 may be considered the back side. The holes 110 may project approximately parallel to the fluid flow in the rake head 102 and/or to the direction that the handle 101 extends. Thus, the holes 110 may project in a direction approximately perpendicular to an extension direction of the tines 103. The holes 110 also may be at different angles to provide desired fluid flow.

Figure 5:
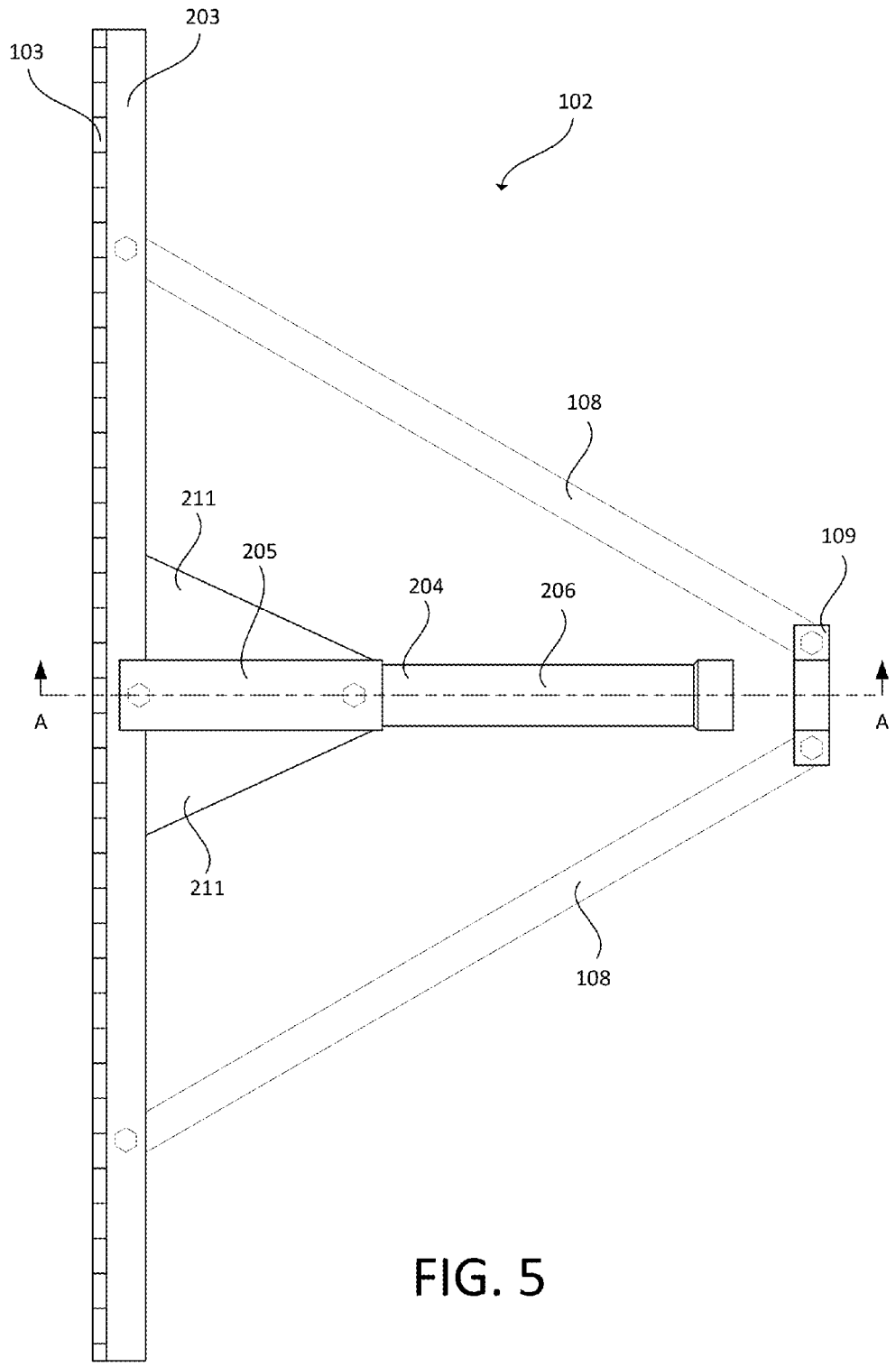
FIG. 5 shows a top view of an embodiment of a rake head in accordance with the present disclosure.

FIG. 5 shows a top view of an embodiment of a rake head 102. The rake head 102 includes a crossbar 203. Multiple tines 103 project from the crossbar 203. A support member 204 extends from the crossbar 203 and is configured to hold a handle, as seen in the embodiment of FIG. 4. The support member 204 in the embodiment of FIG. 5 includes a second end 206 configured to receive a handle, such as the handle 101, and a first end 205 proximate the crossbar 203. In an example, the first end 205 and second end 206 are both fabricated of the same material as the crossbar 203, such as aluminum or an aluminum alloy. In another example, the first end 205 is fabricated of the same material as the crossbar 203 and the second end 206 is fabricated of a different suitable material.

Arms 108 and the guide member 109 can support the handle and can help align the handle with the second end 206 of the support member 204.

The first end 205 of the support member 204 may include support plates 211. The support plates 211 can reinforce the support member 204.

Figure 6:
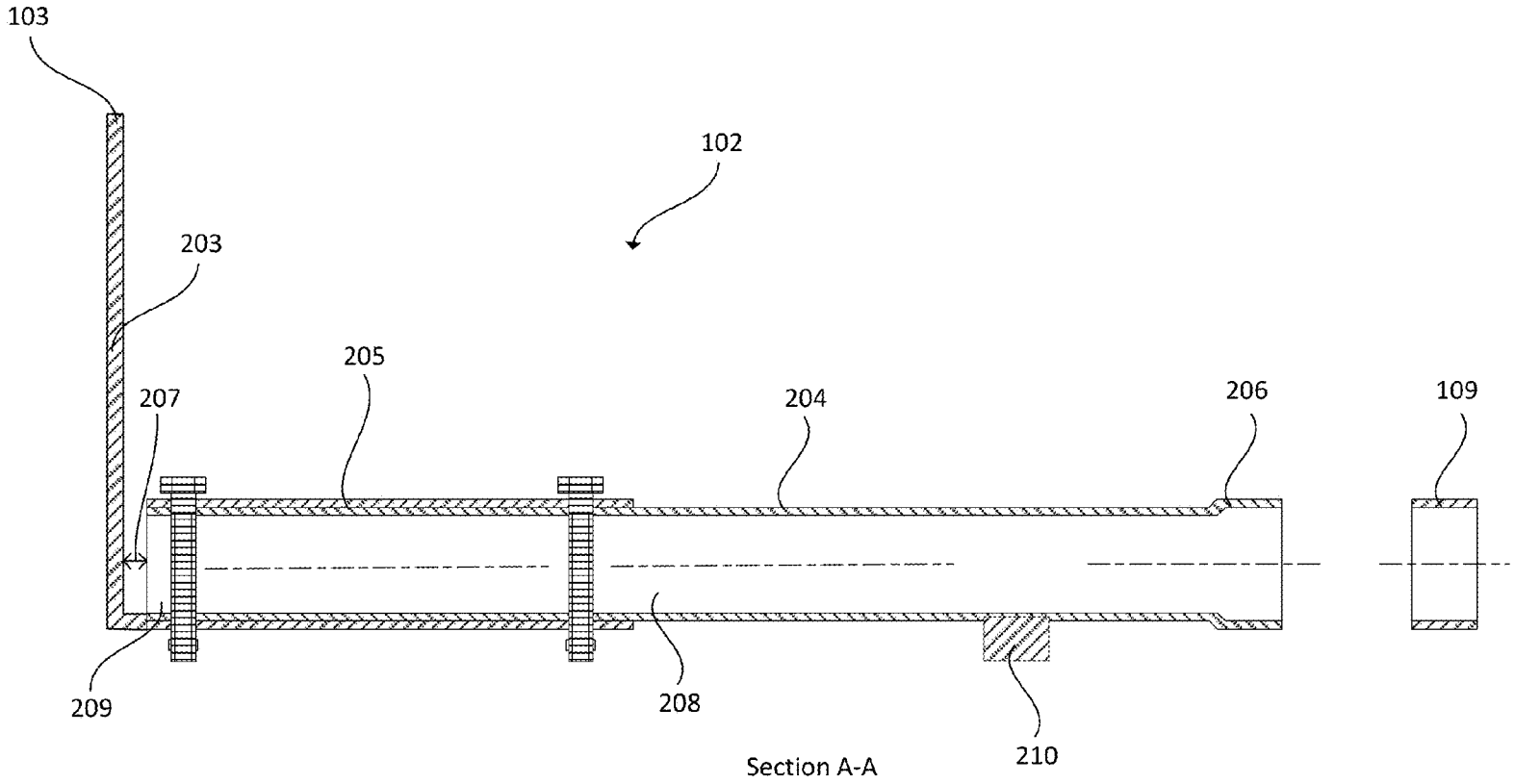
FIG. 6 shows a corresponding cross-sectional side view of an embodiment of the rake head of FIG. 5 along line A-A.

FIG. 6 shows a corresponding cross-sectional side view of an embodiment of the rake head 102 of FIG. 5 along line A-A. As seen in FIG. 6, the support member 204 has a passage 208 in fluid communication with a support member outlet 209 at the first end 205. The passage 208 has a straight bore, though the passage 208 may taper or widen in other embodiments. The first end 205 of the support member 204 is positioned apart from the crossbar 203 by a gap 207 (illustrated with a double-sided arrow). The gap 207 between the walls of the support member 204 at the support member outlet 209 and the crossbar 203 may have a length of less than 0.5 inches, less than 0.25 inches, less than 0.125 inches, or other distances.

A handle, such as the handle 101, may be screwed, press-fitted, latched, connected using wing-nuts, or otherwise connected to the support member 204. Thus, the walls of the passage 208 at the second end 206 may include threaded grooves (e.g., a female connection). Use of a screw connection may enable a user to quickly connect and disconnect a handle. A seal may be formed between the handle and the support member 204, which reduces leaks. Gaskets, o-rings, or other mechanisms can be used to improve the seal.

The handle, such as the handle 101, may be temporarily connected to the support member 204, which enables the handle to be easily disconnected from the support member 204. For example, the handle may be disconnected from the support member 204 to swap the handle between rake heads. The handle also may be more permanently connected to the support member 204, such as using bolts, screws, or other fasteners. A more permanent connection may prevent leaks at the point of connection.

A level bubble 210 may be disposed on the support member 204. The level bubble 210 also may be disposed on the crossbar 203 or other locations on the support member 204 than that illustrated in FIG. 6. The level bubble 210 can assist a user to determine if the raked surface is level or at a desired incline.

The support member 204 also may include a scraper and scraper holder. This may be positioned on the side of the rake head 102 with the tines 103, on the side of the rake head 102 opposite the tines 103, or in other positions. The scraper holder may be a pouch or clip to hold the scraper.

The surfaces of the rake head 102, such as the crossbar 203, may be relatively planar. Channels or grooves also may be formed in the surface of the rake head 102, such as in the crossbar 203, to encourage or guide fluid flow to the tines. The channels or grooves may extend outward from proximate the support member outlet 209 and lead to the individual tines 103. Channels or grooves also may extend from the holes 110 to the tines 103.

In an embodiment, a series of internal channels in the rake head 102 carry fluid from the handle. The internal channels may be positioned between the distal end of the handle to the tines. These channels are formed in the interior of the rake head and can serve as a distribution network in fluid communication with the outlet of the handle. And outlet of the internal channels may be disposed proximate each of the tines 103. The outlets of the internal channels may be positioned on both sides of the rake head 102, such as on both the first side 111 and the second side 112 of the rake head 102.

Figure 7:
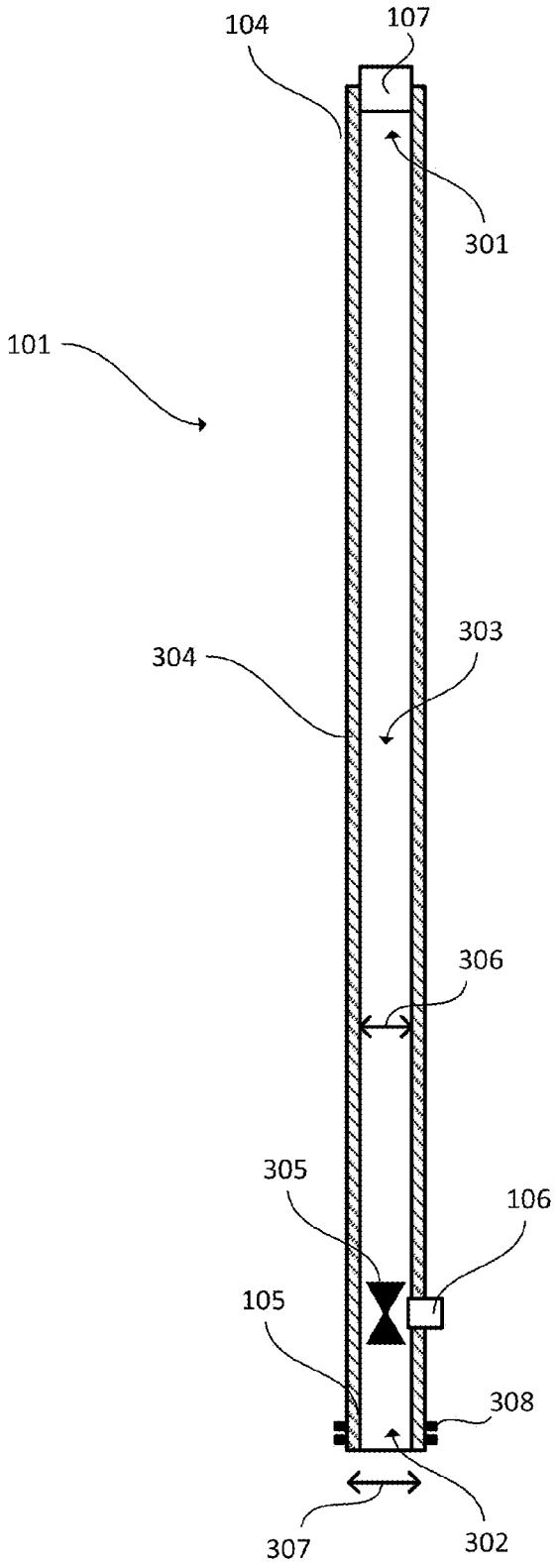
FIG. 7 is a cross-sectional view of an embodiment of a handle in accordance with the present disclosure.

FIG. 7 is a cross-sectional view of an embodiment of a handle 101 with the proximal end 104 and distal end 105. As seen in FIG. 7, a cap 107 is positioned in the inlet 301 at the proximal end 104. The outlet 302 is positioned at the distal end 105. A cavity 303 is formed by the walls 304 of the handle 101 can be used as a reservoir for fluid, such as a release agent.

In an instance, the cavity 303 is the entire length of the handle, though other dimensions or configurations are possible. For example, the cavity 303 may include at least 1 quart of fluid. The cavity 303 can hold approximately 1 quart or 1.5 quarts of fluid. Other volumes are possible.

A valve 305 is disposed in the handle 101. The valve 305 is connected to the activator 106. The valve 305 is configured to control fluid flowing from the reservoir in the handle 101 to the rake head 102. The valve 305 may be a butterfly valve, needle valve, or another type of valve. The activator 106 can be a knob, switch, or other device.

The valve 305 and/or activator 106 may be positioned in the handle 101 in a manner that maximizes the volume of the reservoir. Of course, the valve 305 and/or activator 106 can be positioned in a manner that reduces the volume of the reservoir to increase a user's comfort during operation or for other reasons. The valve 305 may be disposed more proximate to the outlet 302 of the handle 101 than the inlet 301 of the handle 101.

In an instance, the outer diameter 307 of the handle 101 is 1.375 inches and the inner diameter 306 of the handle 101 is 1.25 inches. The handle 101 may be approximately 6 or 7 feet long. Other diameters or lengths are possible. For example, different diameters or lengths may be used so that users with different heights, weights, or arm lengths can work comfortably.

In an instance, the handle 101 is fabricated of aluminum. However, the handle 101 can be PVC or other materials. The cap 107 may be fabricated of PVC, rubber, other plastics, or other materials.

The end of the handle 101 with the outlet 302 can include a thread 308 for a connection with the rake head. The thread 308 can be aluminum, an aluminum alloy, or other materials.

In another embodiment, the inlet 301 is in fluid communication with another fluid source, such as a larger container. For example, the inlet 301 may be connected to a hose that is connected to a bottle clipped to a user or a backpack with a storage tank worn by a user. This increases the amount of fluid that can be carried and reduces the frequency of refilling the handle 101.

In yet another embodiment, the handle 101 is pressurized using $CO_2$, air, or other gases. A pressure cartridge may be in fluid connection with the cavity 303 of the handle 101. The pressure cartridge can help expel fluid from the handle 101 and/or expel fluid onto the crossbar 203. The pressure cartridge may be disposable or may be rechargeable.

While the valve 305 is disposed in the handle 101, the valve 305 also can be disposed in the rake head 102. The activator 106 also can be disposed on the rake head 102.

The distal end 105 also may be configured to receive a cap, which may be like the cap 107. This can prevent fluid spillage when the handle 101 is disconnected from a rake head, such as a when changing rake heads or during transport.

In the embodiments disclosed herein, the rake head can be wholly or partly fabricated of, for example, aluminum, magnesium, steel, alloys thereof, wood, or other suitable materials. In a particular embodiment, the asphalt rake is approximately seven feet long. The rake heads may have a width from approximately 18 inches to 48 inches. For example, the rake head may have a width of approximately 18, 24, 30, 26, 42, or 48 inches. The exact size, construction, and design may vary with the type of material be raked, user, or application.

Embodiments disclosed herein can hold a fluid, such as a release agent, in the reservoir of the handle and can release the fluid using a valve. For example, a knob may be disposed on or near the rake head, which can enable a user to select how much fluid is needed for a particular job. The valve can control the amount of fluid that is dispensed or can entirely stop the fluid flow.

In some embodiments of the asphalt rake, various interchangeable rake heads can be mounted onto the handle 101 for specific asphalt types. Thus, a second rake head with a second support member, which is a different type of rake head (e.g., a top rake or a binder rake), can be attached to the handle. Multiple interchangeable rake heads may be used depending on the job or type of asphalt. This eliminates the need to bring multiple rakes to a worksite. The valve may be closed when the rake heads are switched. For example, different rake heads may be used for a top course, binder course, and base course.

The fluid can be a release agent such as G-Slide (manufactured by L & L Quality Products), Bio Slide (manufactured by Bio Systems, Inc.), fuel oil, diesel fuel, or other lubricants. Other fluids may be used depending on the raking application. While not necessary, some users may select a fluid that has the lowest environmental impact and/or is biodegradable.

Figure 8:
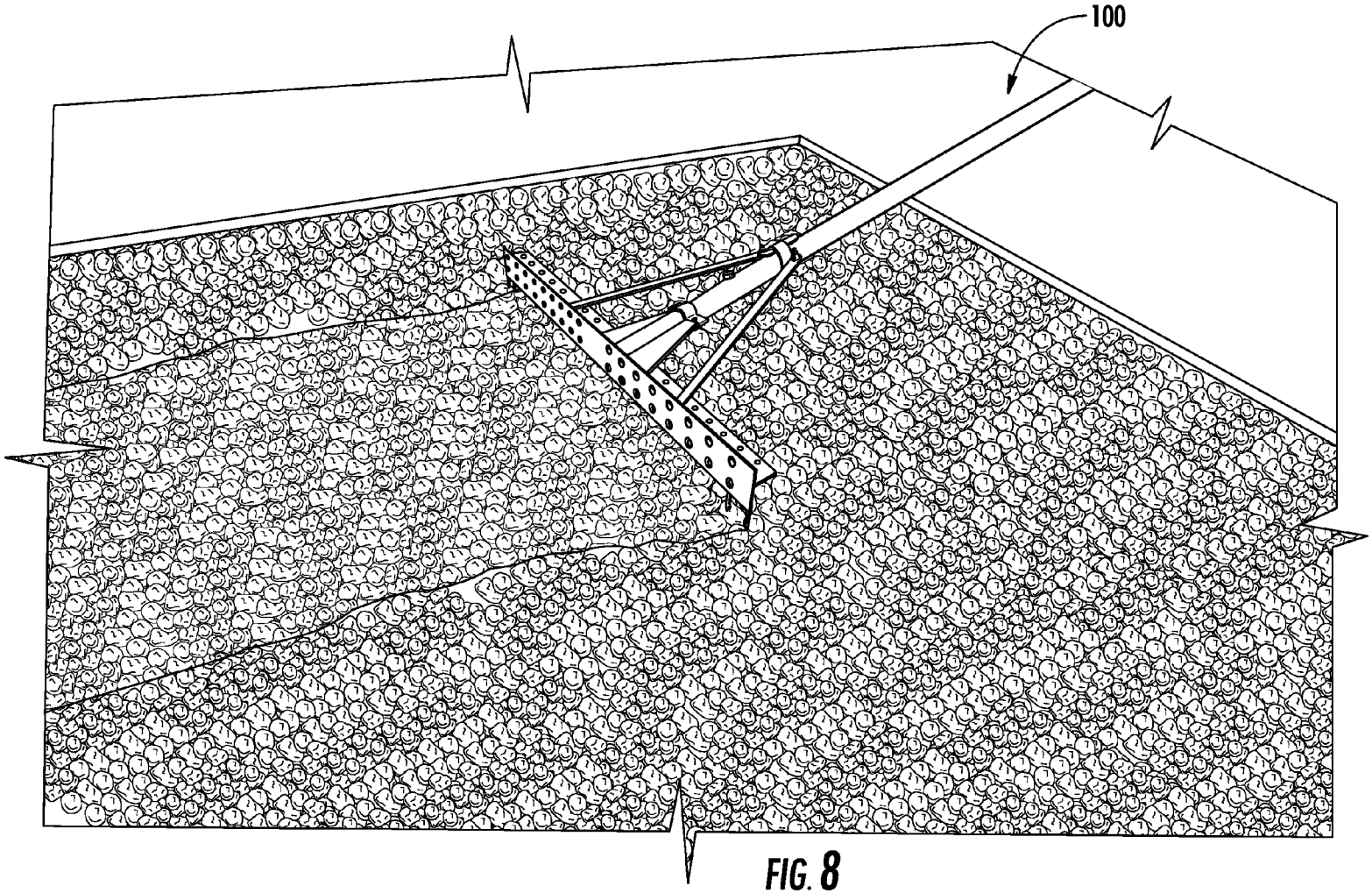
FIG. 8 shows a perspective view of the self-lubricating asphalt rake in use.

FIG. 8 shows a perspective view of the self-lubricating asphalt rake 100 in use. A user first fills up the reservoir in the handle with fluid, such as release agent, and then controls how much fluid is released onto the tines via the activator. Fluid is released over the tines, ensuring that asphalt does not stick to the rake head. The fluid allows a user to conveniently apply release agent before and/or while working with asphalt, saving time and energy.

During use, a user can use the activator 106 to open the valve 305. Fluid will flow from the handle to the rake head 102. Fluid will exit through the support member outlet 209 onto the rake head 102. Gravity can be used to cause the fluid to flow down the tines 103. A user may tilt the rake from side to side such that the fluid flows down the length of the rake head 102 from the support member outlet 209 in both directions away from the support member outlet 209. The fluid may pass through holes on the rake head 102, such as the holes 110. All the tines 103 may be wetted in this manner.

Gravity, surface tension, capillary action, or other mechanisms can provide a continuous stream of fluid onto the previously-wetted tines. Thus, the valve 305 can be opened and fluid may continuously stream down the wetted tines while a user is raking.

In an instance, the support member outlet 209 has a diameter of 0.25 inches. The diameter of the support member outlet 209 may be larger or smaller. For example, the support member outlet 209 may have a diameter from 1 inch to 0.1 inches, include all values and ranges between.

A user can close the valve 305 using the activator 106 prior to raking. The user also may leave the valve 305 open to provide a flow of fluid onto the rake tines while raking. A user can close the valve 305 when switching rake heads.

The holes 110, seen in FIG. 4, can allow the fluid to coat both the first side 111 and second side 112 of the rake head 102 and/or the tines 103.

In an embodiment, at least part of the exterior surface of the rake head 102 is coated with a non-stick coating. The non-stick coating may include, for example, polytetrafluoroethylene (PTFE), an electroless nickel compound, graphite, a polymer, molybdenum disulfide, or other materials. Such a coating may have a low coefficient of friction, which can reduce an amount of asphalt that sticks to the rake head 102. The entire rake head 102 may be coated with the non-stick coating, just the tines 103 may be coated with the non-stick coating, the tines 103 and crossbar 203 may be coated with the non-stick coating, or other parts of the rake head 102 may be coated with the non-stick coating.

While disclosed with respect to asphalt, embodiments disclosed herein can be applied to other types or rakes or other hand tools.

Embodiments disclosed herein reduce or eliminate asphalt that sticks to the rake head. This can improve efficiency because users are not constantly cleaning asphalt from the rake head. Jobs can be completed faster and with fewer interruptions. Furthermore, this can reduce stress on a user's arms or back because the rake, without clumped asphalt, has less weight associated with it. For example, 1 lb. of asphalt or more may stick to the rake head in the absence of lubrication. Balance of the rake also may be improved without asphalt clumped to the rake head, which may be more comfortable for a user.

Efficiency also is improved because a user may need to clean the rake head by heating and scraping less frequently.

Reducing asphalt buildup on the rake head can improve the finished asphalt product. For example, a road or driveway will have a smoother final surface if the rake head has less asphalt stuck to it.

Reducing asphalt buildup on the rake head also can enable a user to work in colder weather. Asphalt typically sticks to a rake head more in colder weather, which makes it more difficult to work.

As the fluid is dispensed directly to the rake head and the fluid can be more safely poured into the reservoir, exposure by a user to the fluid is reduced. For example, the fluid does not need to be manually wiped or sprayed onto the rake head, leading to less contact with a user's skin. A user's exposure to potentially harmful vapors of a fluid that is sprayed on the rake head is also reduced. Some release agents are flammable, have harmful vapors, or are otherwise hazardous to users.

Furthermore, the embodiments disclosed herein provide for a cleaner worksite. Less of the fluid is spilled, which can benefit the environment. For example, less fluid may be spilled outside of the asphalt, such as on a lawn, in a flower bed, or near waterways.

Although the present disclosure has been described with respect to one or more particular embodiments, it will be understood that other embodiments of the present disclosure may be made without departing from the scope of the present disclosure. Hence, the present disclosure is deemed limited only by the appended claims and the reasonable interpretation thereof.

What is claimed is:

1. An asphalt rake comprising:

a handle, wherein the handle defines a cavity, an inlet in fluid communication with the cavity, and an outlet in fluid communication with the cavity, wherein the inlet is disposed on a proximal end of the handle and the outlet is disposed on a distal end of the handle, and wherein the cavity is disposed between the inlet and the outlet;

a rake head including:

a crossbar, wherein the crossbar defines a plurality of holes between a first side and a second side, wherein the holes in the crossbar are configured to enable fluid flow between the first side and the second side of the rake head;

a plurality of tines projecting from the crossbar; and a support member configured to hold the handle, wherein the support member has a passage in fluid communication with the outlet of the handle, wherein the passage is in fluid communication with a support member outlet that is configured to be positioned apart from the crossbar by a gap, wherein the gap is defined between a wall of the support member and a surface of the first side of the crossbar, wherein an element of the support member is disposed between the crossbar and the support member outlet, wherein the wall of the support member, the surface of the first side of the crossbar, and the element define an open space in the gap, and wherein the support member outlet is positioned to provide fluid flow across the gap to the first side of the rake head;

a cap disposed on the handle, wherein the cap is configured to seal the inlet; and a valve disposed in the handle, wherein the valve is configured to control fluid flowing from the cavity in the handle to the rake head.

2. The asphalt rake of claim 1, wherein the cavity is configured to hold at least a quart of fluid.

3. The asphalt rake of claim 1, further comprising a bubble level disposed on the support member.

4. The asphalt rake of claim 1, further comprising a pair of support arms and a collar, wherein the collar is disposed around the handle and wherein the support arms connect the collar to the rake head.

5. The asphalt rake of claim 1, wherein the rake head is fabricated entirely of aluminum or an aluminum alloy.

6. The asphalt rake of claim 1, further comprising an activator connected to the valve.

7. The asphalt rake of claim 1, wherein the rake head is configured to connect with the handle using a screw connection.

8. The asphalt rake of claim 7, wherein the handle is configured to be disconnected from the rake head.

9. The asphalt rake of claim 7, further comprising a second rake head, wherein the second rake head is different from the rake head, wherein the second rake head includes a second support member configured to hold the handle, and wherein the second rake head is configured to be connected with the handle.

10. The asphalt rake of claim 1, wherein the passage of the support member is configured to enable fluid flow to the crossbar.

11. The asphalt rake of claim 10, wherein the passage has a straight bore.

12. The asphalt rake of claim 1, wherein the valve is disposed more proximate to the outlet of the handle than the inlet of the handle.

13. The asphalt rake of claim 1, wherein a seal is formed between the handle and the support member.

14. The asphalt rake of claim 1, wherein the holes in the crossbar project approximately parallel to the fluid flow in the rake head.

15. The asphalt rake of claim 1, wherein the holes in the crossbar project approximately parallel to the direction that the handle extends.

16. The asphalt rake of claim 1, wherein at least part of an exterior surface of the rake head includes a non-stick coating.

17. The asphalt rake of claim 1, wherein the element extends less than an entirety around a perimeter of the wall of the support member surrounding the support member outlet.

* * * * *